US006020564A

United States Patent [19]

Wang et al.

[11] Patent Number: 6,020,564

[45] Date of Patent: Feb. 1, 2000

[54] LOW-VOLTAGE LONG LIFE ELECTROSTATIC MICROELECTROMECHANICAL SYSTEM SWITCHES FOR RADIO-FREQUENCY APPLICATIONS

[75] Inventors: Johnson J. H. Wang; Gregory T. Thompson, both of Marietta, Ga.

[73] Assignee: Wang Electro-Opto Corporation, Marietta, Ga.

[21] Appl. No.: 09/090,702

[22] Filed: Jun. 4, 1998

[51] Int. Cl.[7] ..... H01H 59/00

[52] U.S. Cl. ..... 200/181

[58] Field of Search ..... 200/61.45 R, 61.48–61.51, 200/181; 333/101–108, 262

[56] References Cited

U.S. PATENT DOCUMENTS

| | | | |
|---|---|---|---|
| 4,674,180 | 6/1987 | Zavracky et al. | 29/622 |
| 5,121,089 | 6/1992 | Larson | 333/107 |
| 5,258,591 | 11/1993 | Buck | 200/181 |
| 5,367,136 | 11/1994 | Buck | 200/600 |
| 5,410,799 | 5/1995 | Thomas | 29/622 |
| 5,489,556 | 2/1996 | Li et al. | 437/228 |
| 5,578,976 | 11/1996 | Yao | 333/262 |
| 5,619,061 | 4/1997 | Goldsmith et al. | 257/528 |
| 5,638,946 | 6/1997 | Zavracky | 200/181 |

*Primary Examiner*—J. R. Scott

*Attorney, Agent, or Firm*—Thomas, Kayden, Horstemeyer & Risley, L.L.P.

[57] ABSTRACT

A micro-electromechanical switch which comprises a flexible longitudinal beam disposed adjacent to first and second contact members which form a gap in, for example, a radio frequency transmission line to control the flow of the radio frequency signal. At least one actuating beam is attached to at least one end of the flexible longitudinal beam. Also an actuating member is disposed adjacent to the actuating beam so as to generate an electrostatic force therebetween upon the application of a voltage across the actuating beam and the actuating member. When the voltage is applied, the actuating beam bends and thus applies a longitudinal force and torque on the joint between the actuating beam and the flexible longitudinal beam. This longitudinal force and torque cause the flexible longitudinal beam to bend laterally toward the first and second contact members, thereby completing the electrical circuit attached to the first and second contact members. In this invention, a small movement in the actuating beam causes a large lateral bending of the longitudinal beam; allowing good electrical performance, high isolation and low insertion loss with a small actuating voltage.

20 Claims, 14 Drawing Sheets

LOW-VOLTAGE LONG LIFE ELECTROSTATIC MICROELECTROMECHANICAL SYSTEM SWITCHES FOR RADIO-FREQUENCY APPLICATIONS

GOVERNMENT LICENSE RIGHTS

The U.S. Government has a paid-up license in this invention and the right in limited circumstances to require the patent owner to license others on reasonable terms as provided for by the terms of Contract No. DAAB07-97-C-D077 awarded by the United States Army.

FIELD OF THE INVENTION

This invention relates to the field of micro -machined devices and, more particularly, to micro-electromechanical switches.

BACKGROUND OF THE INVENTION

A radio-frequency (RF) switch is a device that controls the flow of an RF signal, or it may be a device that controls a component or device in an RF circuit or system in which an RF signal is conveyed. As is contemplated herein, an RF signal is one which encompasses low and high RF frequencies over the entire spectrum of the electromagnetic waves, from a few Hertz to microwave and millimeter-wave frequencies. A micro-electromechanical system (MEMS) is a device or system fabricated using semiconductor integrated circuit (IC) fabrication technology. A MEMS switch is such a device that controls the flow of an RF signal. MEMS devices are small in size, being fabricated using IC fabrication methods. A MEMS switch features significant advantages in that its small size translates into a high electrical performance, since stray capacitance and inductance are virtually eliminated in such an electrically small structure as measured in wavelengths. In addition, a MEMS switch also is potentially low-cost due to the IC manufacturing process employed in its fabrication.

MEMS switches are termed electrostatic MEMS switches if they are actuated or controlled using electrostatic force which turns such switches on and off. Electrostatic MEMS switches are advantageous due to low power-consumption because they can be actuated using electrostatic force induced by the application of a voltage with virtually no current. This advantage is of paramount importance for portable systems, which are operated by small batteries with very limited stored energy. Such portable systems might include hand-held cellular phones and laptop personal computers, for which power-consumption is recognized as a significant operating limitation.

Even for systems that have a sufficient AC or DC power supply such as those operating in a building with AC power outlets or in a car with a large DC battery and a generator, low power-consumption is still a desirable feature because power dissipation creates heat which can be a problem in a circuit loaded with many IC's.

However, a major disadvantage exists in prior art MEMS switches, which require a large voltage to actuate the MEMS switch. Such a voltage is typically termed a "pulldown" voltage, and, in the prior art may be anywhere from 20 to 40 volts in magnitude and therefore not compatible with modem portable communications systems, which typically operate at 3 volts or less.

To explain further, the typical MEMS switch uses electrostatic force to cause mechanical movement that results in electrically bridging a gap between two contacts such as in the bending of a cantilever. In general this gap is relatively large in order to achieve a large impedance during the "off" state of the MEMS switch. Consequently, the aforementioned large pulldown voltage of anywhere from 20 to 40 volts is usually required in these designs to electrically bridge the large gap.

Also, a typical MEMS switch has a useful life of approximately $10^6$ to $10^8$ cycles due to fatigue. Thus, in addition to the above concerns, there is an interest in increasing he fatigue life of such MEMS switches.

Thus there is a need for an electrostatic MEMS switch that is actuated by a low pulldown or actuating voltage and low power consumption with increased cycle life.

SUMMARY OF THE INVENTION

To address the above concerns, the present invention provides for a flexible longitudinal beam of predetermined design and a means for introducing a longitudinal force on the flexible longitudinal beam. This longitudinal force may be either compression or tension as illustrated hereinafter in the different embodiments of the present invention.

When applied, the longitudinal force creates a torque which causes the flexible longitudinal beam to laterally bend so as to move close to or in contact with two contact members having a gap therebetween. In this manner, the flexible longitudinal beam electrically bridges the gap between two contact members, thereby completing an electrical circuit of which the two contact members are a part.

According to the present invention, the longitudinal force is exerted by at least one actuating beam attached to an end of the flexible longitudinal beam, the opposite end of the actuating beam being attached to a substrate. An actuation member is placed adjacent to the actuating beam. An electrostatic force is generated between the actuating beam and the actuation member when a voltage or voltage difference is applied to both, causing the movement of the end of the actuating beam which is attached to the flexible longitudinal beam, thereby generating the longitudinal force and torque which causes the flexible longitudinal beam to bend.

The present invention is advantageous in that a relatively small movement created in at least one actuating beam causes a corresponding large lateral bending in the flexible longitudinal beam. This small movement is achieved by the application of a relatively small electrostatic force. Consequently, the voltage required to generate the electrostatic force is correspondingly low. As a result, the present invention provides for the desired high impedance gap in the "off" state, while allowing the electrical bridging of this gap with a relatively low voltage.

In addition, the lower operating voltages result in lower power consumption and lower heat generation.

Also, when the present invention is used in designs allowing a higher voltage, the resulting switch has a better performance than prior art electrostatic MEMS switches, including robustness against mechanical and thermal disturbances and shocks as well as higher isolation and lower insertion loss.

Also, the present invention features drastically reduced movement, resulting in less stress and fatigue to the component parts. Since the fatigue life typically increases drastically with reduced stress, the reduction of stress in the present invention can lead to drastically increased fatigue life in comparison to prior art electrostatic MEMS switches.

Other features and advantages of the present invention will become apparent to one with skill in the art upon examination of the following drawings and detailed description. It is intended that all such additional features and advantages be included herein as being within the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION OF THE PREFERRED EMBODIMENT

Figure 1A:
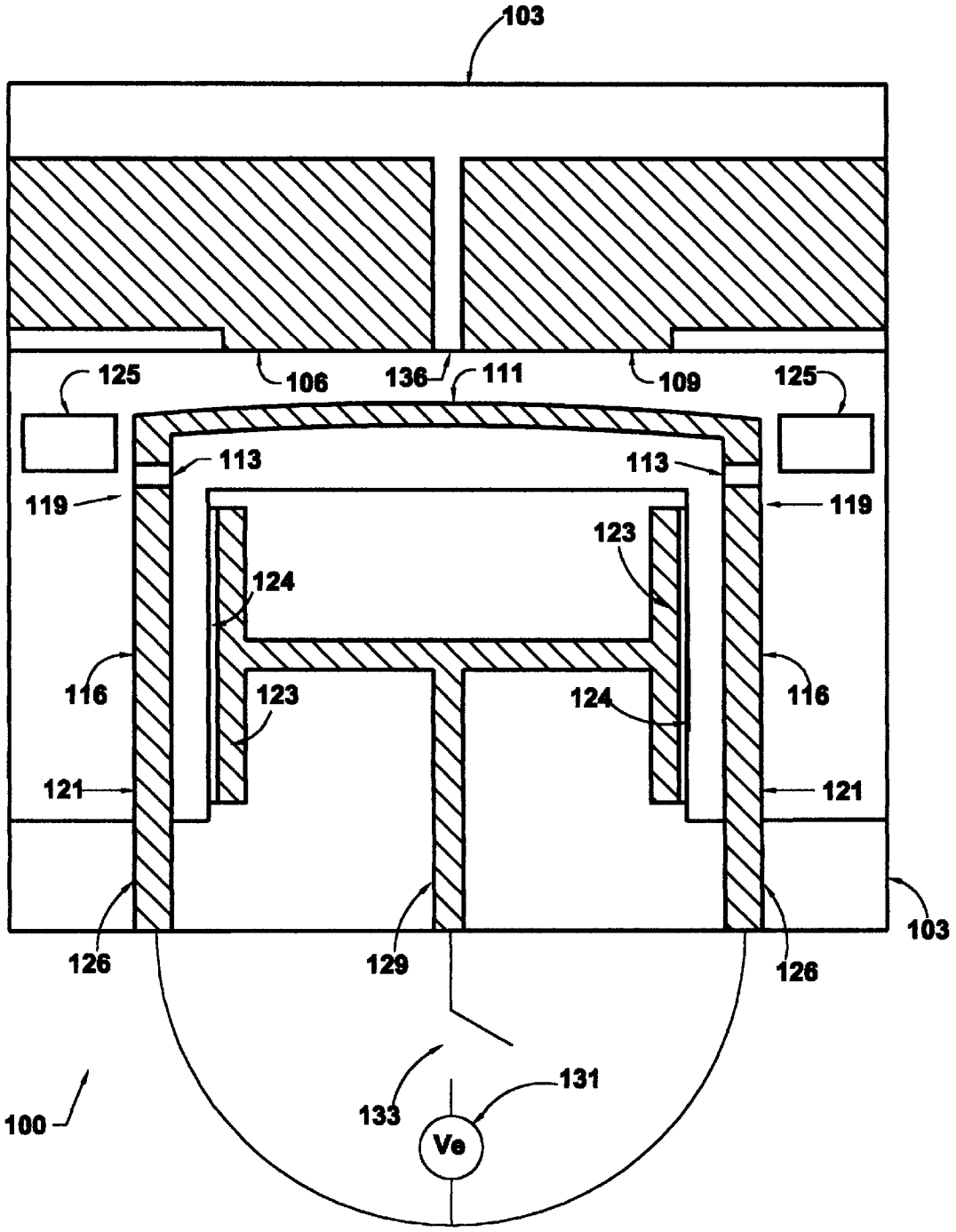
FIG. 1A is a plan cross-sectional view of a micro-electromechanical switch according to a first embodiment in the "off" position.

Turning to FIG. 1A, there is shown a micro-electromechanical switch 100 according to one embodiment of the present invention. The micro-electromechanical switch 100 is fabricated using semiconductor integrated circuit fabrication technology which is known by those skilled in the art. The micro-electromechanical switch 100 comprises a substrate 103 on which is disposed a first contact member 106 and a second contact member 109. Disposed adjacent to the first and second contact members 106 and 109 is a flexible longitudinal beam 111. Both ends of the flexible longitudinal beam 111 are connected via insulation members 113 to actuating beams 116. In FIG. 1A and various figures referred to hereafter, conductive members are indicated by cross-hatching when necessary to improve the clarity of the respective figures.

Each actuating beam 116 features a moveable end 119 and a fixed end 121. The fixed end 121 is attached to the substrate 103 while the moveable end 119 is attached to the insulation member 113. An actuation member 123 is disposed in the substrate 103 adjacent to each actuating beam 116 as shown. In the preferred embodiment, the actuation member 123 is an electrode. Covering the actuation member 123 is a dielectric member 124. Disposed near the moveable ends 119 of the actuating beams 116 are blockers 125. The blockers 125 are actually protrusions of the substrate 103. The actuating beams 116 have electrical connections 126 and the actuating members 123 have electrical connections 129 to be coupled to a voltage source 131. As shown schematically, the voltage $V_e$ is applied across the actuating beams 116 and the actuating members 123 when the micro-electromechanical switch 100 is activated by closure of switch 133, for example. Note that the switch 133 is for purposes of illustration and is representative of any one of a number of circuit components that may supply the voltage $V_e$ to the micro-electromechanical switch 100 such as, for example, a transistor. In the preferred embodiment, the voltage $V_e$ can be supplied by other components fabricated in a single integrated circuit with the micro-electromechanical switch 100.

Figure 1B:
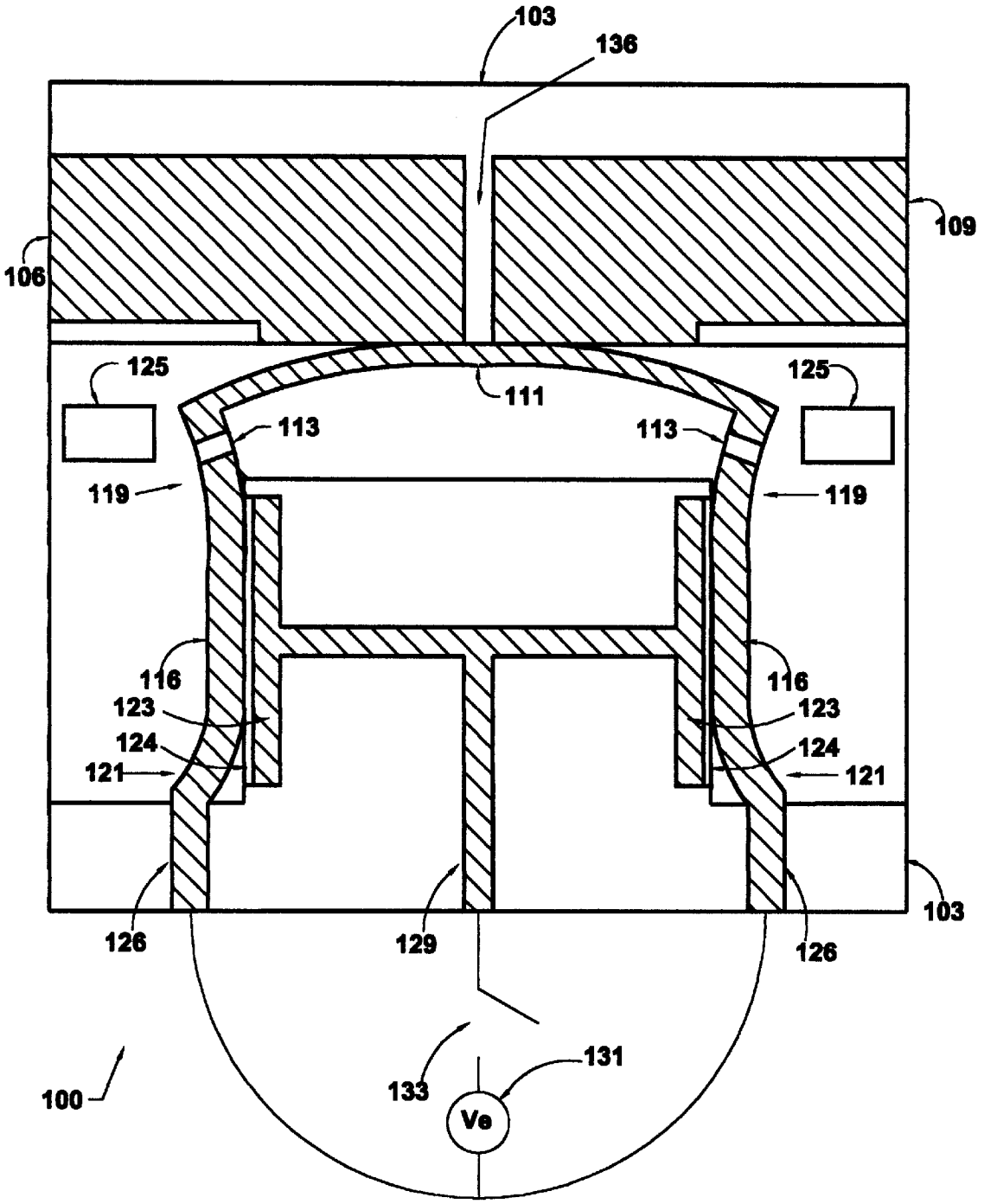
FIG. 1B is a plan cross-sectional view of a micro-electromechanical switch of FIG. 1A in the "on" position.

Referring next to FIG. 1B, next the general operation of the micro-electromechanical switch 100 is described. When the voltage $V_e$ is applied to the actuating beams 116 and the actuating members 123, an electrostatic force is developed between them. This electrostatic force causes the actuating beams 116 to bend toward the actuating members 123 as shown in FIG. 1B. The bending of the actuating beams 116 in turn causes the moveable ends 119 to exert a longitudinal force and a torque to the ends of the flexible longitudinal beam 111. In the embodiment shown, the longitudinal force is a compression force. The insulation members 113 electrically insulate the flexible longitudinal beam 111 from the voltage $V_e$ applied to the actuating beams 116. The blockers 125 serve to keep the structure symmetrical and balanced thereby mitigating the effects of asymmetry of the overall structure and unbalance of the longitudinal force due to the actuating beams 116.

Note that the dielectric members 124 essentially cover the actuating members 123 and prevent the actuating beams 116 from coming into electrical contact with their respective actuating members 123. This is because actual electrical contact between the actuating members 123 and their respective actuating beams 116 would result in a loss of electrostatic attraction between them when the micro-electromechanical switch 100 is activated.

Although the force applied to the flexible longitudinal beam 111 is a compression force as shown in FIG. 1B, such a force need not be compressive as will be discussed. In response to the longitudinal force and the torque, the flexible longitudinal beam 111 bends laterally toward the first and second contact members 106 and 109 as shown in FIG. 1B. This lateral bending brings the center portion of the flexible longitudinal beam 111 in close proximity to or in contact with the first and second contact members 106 and 109. By being in close proximity to or in contact with the first and second contact members 106 and 109, the flexible longitudinal beam 111 electrically bridges a gap 136 (FIG. 1A) between the first and second contact members 106 and 109 either capacitively or directly. In this manner, an electrical circuit connected to the first and second contact members 106 and 109 is completed.

Thus, the present invention may be viewed as having two primary components. The first is an actuating component which causes the desired movement of the flexible longitudinal beam 111 and the second is the switching component which completes an electrical circuit of which the micro-electromechanical switch 100 is a part. In the following discussion, first the actuating component is discussed in greater detail, followed by further discussion of the switching component.

To describe further the actuating component, discussion starts with the electrostatic attraction between the actuating beams 116 and the actuating members 123. The electrostatic force FE between one actuating beam 116 and its counterpart actuating member 123 is an attractive force due to the application of voltage $V_e$ from voltage source 131 between them. The actuating beams 116 and the actuating members 123 are conductive and generally flat or plate-like in shape, and are positioned adjacent and parallel to each other as is discussed later in this discourse. Thus, the electrostatic force $F_E$ is similar to that between two parallel plates of a capacitor (ignoring fringing fields) and is given by the equation $$F_E = \frac{\varepsilon_0 A\left(\frac{V_E}{\Delta}\right)^2}{2},$$

where A is the area of the smaller one of the plates, Δ is the spacing between the two plates, and $\epsilon_0$ is the permittivity in free space.

When the voltage $V_e$ is applied and the electrostatic force generated, the actuating beams 116 are attracted toward the actuating members 123. As previously stated, a longitudinal force and a torque are generated in the flexible longitudinal beam 111. As a result, the flexible longitudinal beam 111 laterally bends toward the first and second contact members 106 and 109. The force required for this lateral bending in one case is the critical load or Euler load given by the equation $$F_C = \frac{\pi^2 EI}{L^2},$$

where $F_C$ is the critical load, E is Young's modulus, I is the moment of inertia, and L is the length of the flexible longitudinal beam. (See H. W. Coultas, *Theory of Structures*, Fifth Edition, 1961.) The longitudinal force creates a torque at the two ends of the flexible longitudinal beam 111 causing the flexible longitudinal beam 111 to bend.

Note that the Euler load is only one-fourth (¼) of the force needed for the buckling of a long beam with both ends fixed so as not to be free to rotate. However, the Euler load is larger than that necessary to bend a cantilever of the same dimension and material by a factor of about 2 during the initial bending. (See S. P. Timoshenko, Theory of Elasticity, McGraw-Hill, 3rd ed., reissued 1987.) It is worth noting that for successive or larger bending, the force needed for lateral bending by compression could be smaller than that needed for cantilever bending. The implication of this phenomenon is two-fold: (1) lateral bending by compression requires a force of no more than twice that needed for cantilever bending, and (2) if the beam is slightly bent to begin with, the difference in force required between lateral bending by compression and cantilever bending can be further reduced as will be discussed.

With regard to the switching component, in applications where the micro-electromechanical switch 100 is used to complete a circuit conducting direct current ("a DC circuit"), then it is desirable that the flexible longitudinal beam 111 bridge the gap 136 between the first and second contact members 106 and 109 by actually coming into electrical contact with both the first and second contact members 106 and 109 to allow the conduction of DC current.

In applications in which the micro-electromechanical switch 100 is used to complete a radio frequency (RF) transmission line, the flexible longitudinal beam 111 is brought either in direct contact or in close proximity to the first and second contact members 106 and 109 without actually making physical contact. In such an application, the first and second contact members 106 and 109 are interposed in an RF transmission line. The RF signal transmitted along such an RF transmission line may range from low frequencies such as a few Hertz to high frequencies up to the millimeter-wave range. When the flexible longitudinal beam 111 is in the "off" position, a large capacitive impedance is presented by the gap between the first and second contact members 106 and 109. As the distance between the flexible longitudinal beam 111 and both the first and second contact members 106 and 109 decreases due to the lateral bending of the flexible longitudinal beam 111, the effective gap between the first and second contact members 106 and 109 also decreases, and, accordingly, the corresponding capacitive impedance decreases, and vice versa. When the capacitive impedance becomes sufficiently small, the RF signal is transmitted through the first and second contact members 106 and 109 to effect the "on" state. Also, for a given gap, the capacitive impedance decreases with increasing RF signal frequency, and vice versa.

Consequently, in the "off" state, the flexible longitudinal beam 111 is positioned with sufficient distance from both the first and second contact members 106 and 109 so that the capacitive impedance between the first and second contact members 106 and 109 is large and virtually unaffected by the flexible longitudinal beam 111. In practical applications at microwave frequencies, for example, the closest distance in off state between the flexible longitudinal beam 111 and both the first and second contact members 106 and 109 is approximately four microns or so in order to have adequate isolation. Additionally, the flexible longitudinal beam 111 is positioned so that when the voltage $V_e$ is applied to the actuating beams 116 and actuating members 123 in the "on" state, resulting in the lateral bending of the flexible longitudinal beam 111, the distance between the center portion of the longitudinal beam 111 and the first and second contact members 106 and 109 is lessened such that the capacitive impedance presents a low insertion loss to allow the conduction of the RF signal. This distance is generally less than one micron.

Figure 2:
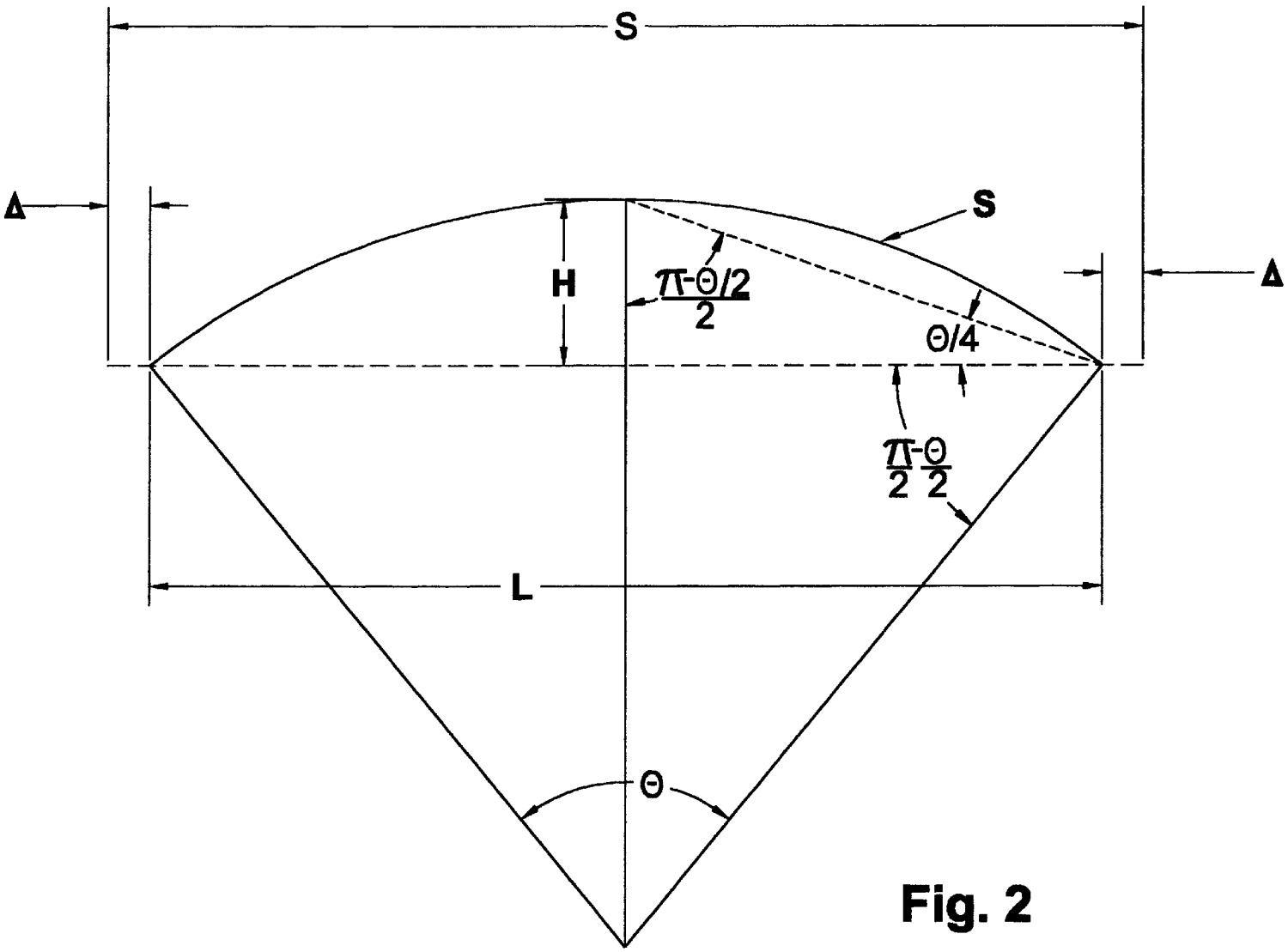
FIG. 2 is a diagram illustrating the geometry of lateral bending of a flexible longitudinal beam shown in FIGS. 1A and 1B in relation to a change in the position of ends of the flexible longitudinal beam.

To further explain, referring to FIG. 2, shown is an example of the flexible longitudinal beam 111 in a straight line and in an arc when bent. The relationship of the longitudinal displacement A of the two ends of the flexible longitudinal beam 111 and the lateral displacement of the center of the beam H is given by $$H = [(S - 2\Delta)/2]\tan\left(\frac{\theta}{4}\right),$$

where S is the constant length of the flexible longitudinal beam 111 and θ is the angle defined by the resulting arc that is formed by the bent flexible longitudinal beam 111. Note that this relationship assumes that the bending of the flexible longitudinal beam 111 is a perfect arc. It is understood that the flexible longitudinal beam 111 of the present invention does not always form a perfect arc when the ends are compressed. However, the actual relationship between the movement of the ends of the flexible longitudinal member 111 and the arc-like motion of the center of the flexible longitudinal beam 111 is substantially similar to the formulaic relationship detailed above.

It should be noted that the lateral movement H in FIG. 2 can be from 4 to 10 times the longitudinal displacement Δ. Thus, according to the present invention, a small longitudinal displacement Δ results in a large lateral displacement H of the center of the flexible longitudinal beam 111. This fact results in a smaller actuation voltage needed to achieve the desired motion than prior art designs. Specifically, most cantilever designs according to the prior art require actuation voltages of 20 to 40 volts to achieve a movement of 4–6 microns. In contrast, the present invention needs to achieve a longitudinal movement Δ of only a 1 micron to cause a lateral movement H of 4–6 microns. Accordingly, the actuation voltage required to achieve this motion can be lower than 5 volts.

The present invention provides a significant advantage in that a relatively large lateral bending motion may be achieved with a relatively small movement in the actuating beams 116. Consequently, the relatively large lateral bending motion may be achieved by exerting a relatively small force on the actuating beams and the electrodes. This means that a lesser voltage is necessary to achieve the lateral bending motion. For example, many cantilevered designs according to the prior art require a "pulldown" voltage as high as 30 volts applied to the actuation components to achieve the necessary movement of the switching portion such that adequate distance exists between the electrical contacts when the switch is not activated, thereby achieving the needed high isolation. The present invention can operate at much lower voltages, including five volts or less which is generally the voltage at which integrated circuits operate. Thus, the present invention eliminates the need for larger, more expensive, high-voltage power supplies when used in various integrated circuits such as portable communications systems and other systems which generally operate at 5 volts or less.

Also, because of the lower operating voltages employed, the present invention features lower operating power resulting in lower power consumption. This further results in less heat dissipation which can be a problem in a circuit loaded with many integrated circuits.

The present invention also provides another distinct advantage in that it can be fabricated using existing semiconductor integrated circuit fabrication technology such as lithography techniques known by those skilled in the art.

Still another benefit of the present invention is that the number of switching cycles the micro-electromechanical switch 100 (FIG. 1A) may endure before its performance deteriorates to an unacceptable level due to fatigue is much larger than prior art designs. This is due to the relatively smaller range of motion in the moveable components of the micro-electromechanical switch 100 and the lesser stresses created in these components.

Also note that it is preferable that the flexible longitudinal beam 111 not be perfectly straight when in a relaxed state. In particular, a slight initial bend is predisposed in the flexible longitudinal beam 111 in the relaxed state. This initial bend reduces the amount of longitudinal force necessary to cause the flexible longitudinal member to laterally bend as desired. The initial bend also predisposes the flexible longitudinal beam 111 to laterally bend in the direction of the initial bend.

The following discussion will detail several embodiments of the present invention. It is understood that the foregoing discussion applies generally to all of the following embodiments.

Figure 3:
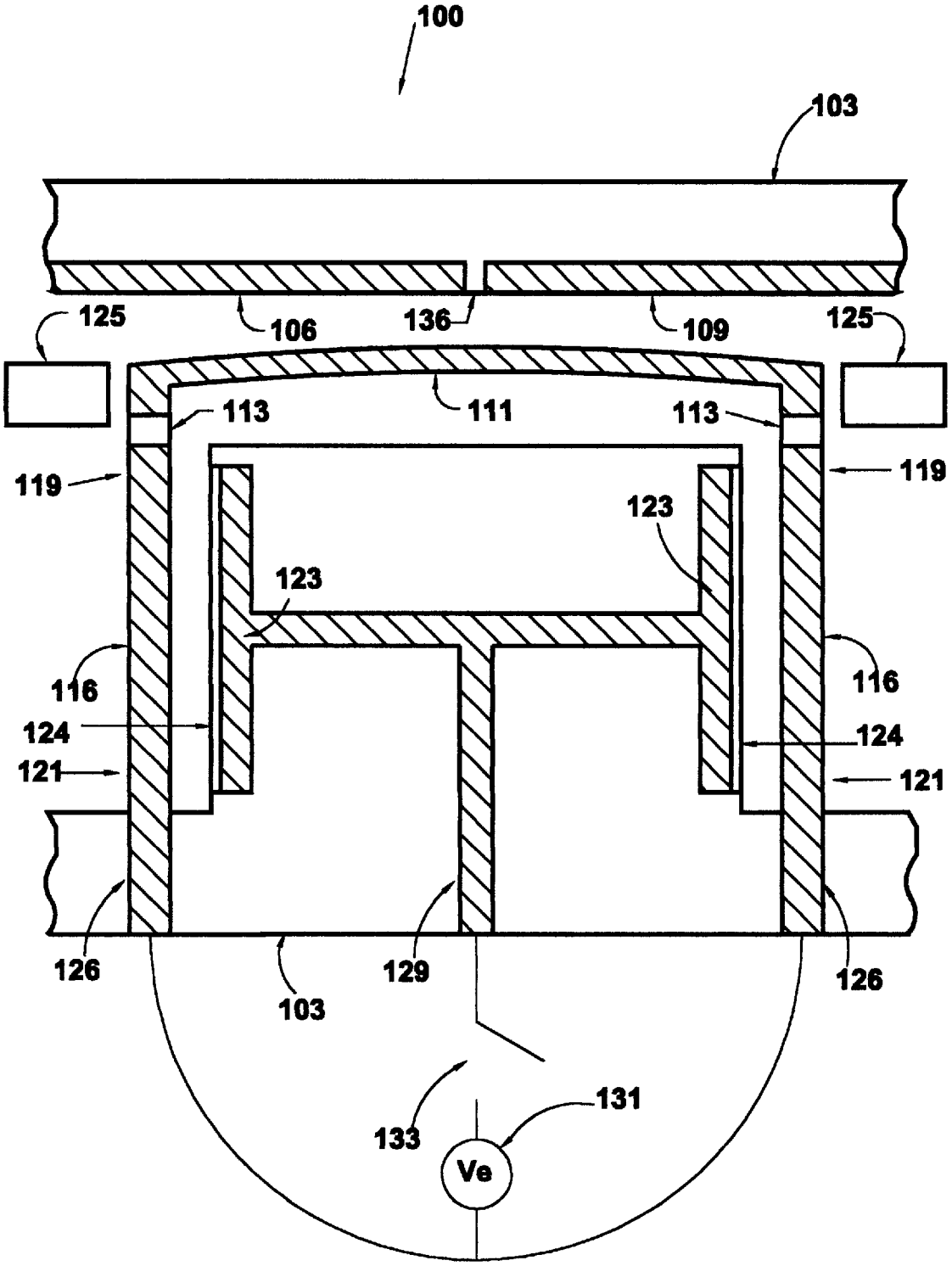
FIG. 3 is a plan cross-sectional view of a micro-electromechanical switch variation of the switch of FIG. 1A.

Turning to FIG. 3, shown is another illustration of the first embodiment of the micro-electromechanical switch 100 according to the present invention. Note that the micro-electromechanical switch 100 is essentially the same as that shown in FIGS. 1A and 1B.

While the dielectric member 124 is included in the preferred embodiment, the micro-electromechanical switch 100 can be constructed without the dielectric member 124. For example, structural designs such as one or more slight protrusions placed on the actuating member 123 or the actuating beams 116 can prevent electrical contact between the actuating beam 116 and the actuating member 123 when the micro-electromechanical switch 100 is activated. Also, the structural design of the actuating beams 116 may be such that they are prevented from bending far enough to make electrical contact with the actuating member 123. Such a design would be a compromise between providing a weak enough structure to allow movement of the actuating beam 116 to create the necessary longitudinal force for switch operation, while limiting its ultimate motion to prevent the unwanted electrical contact with the actuating member 123.

Figure 4:
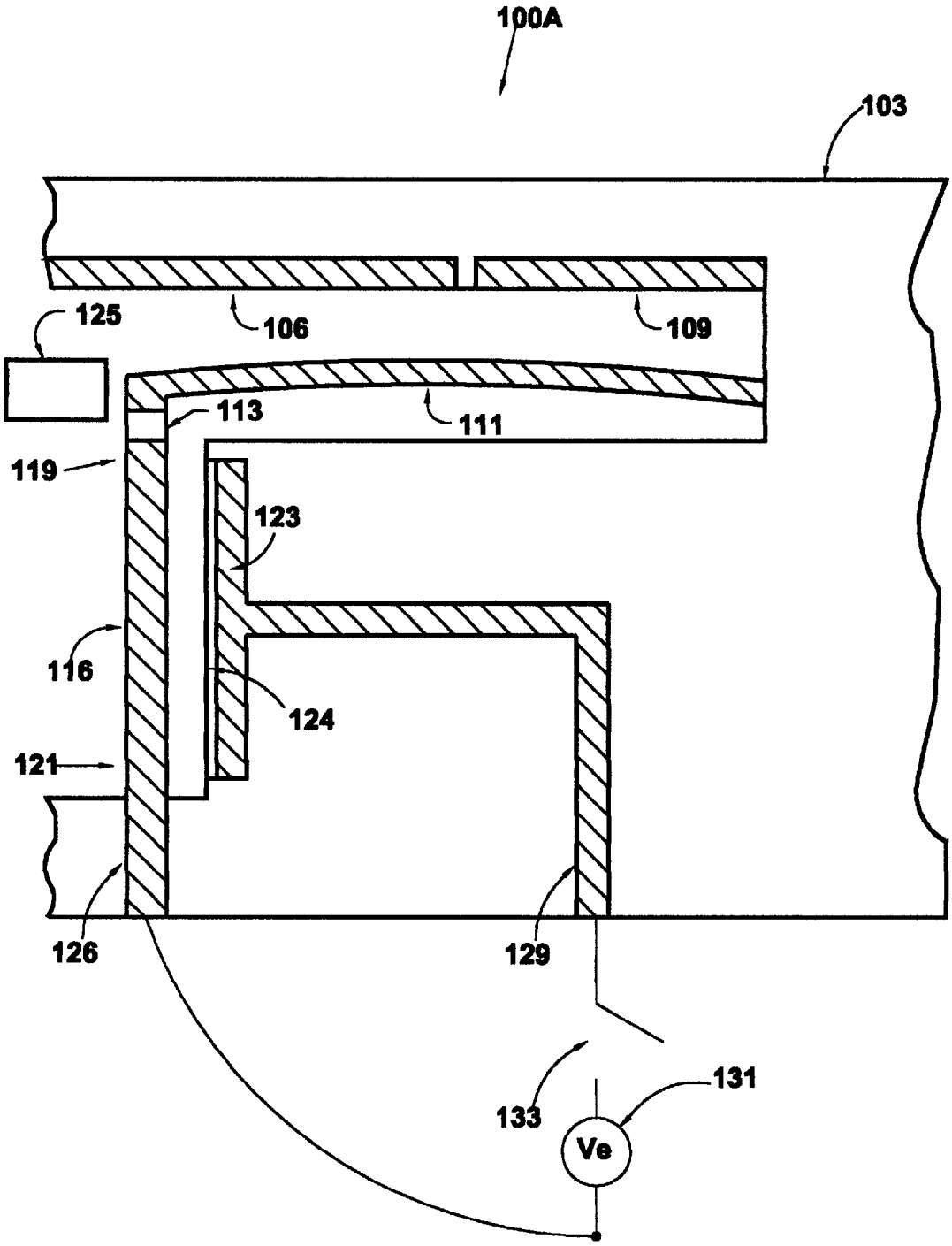
FIG. 4 is a plan cross-sectional view of a micro-electromechanical switch according to a second embodiment of the present invention using a half-switch design.

Referring next to FIG. 4, shown is a micro-electromechanical switch 100A according to a second embodiment of the present invention which is dubbed a "half-switch" design. The second embodiment varies from the first embodiment in that only a single actuating beam 116 is employed. To describe further, a first end of the flexible longitudinal beam 111 is attached to the insulation member 113 which in turn is attached to the moveable end 119 of the actuation beam 116. A second end of the flexible longitudinal beam 111 is attached to the substrate 103. When the voltage $V_e$ is applied to the actuation beam 116 and the actuation member 123, an electrostatic attraction is formed between the actuation beam 116 and the actuation member 123. The flexible longitudinal beam 111 laterally bends toward the first and second contact members 106 and 109 as was discussed with the first embodiment above. Note that the flexible longitudinal beam 111 features a reduced cross section at the point of attachment to the substrate 103. The actuation beam 116 also features a reduced cross section at the fixed end 121. These reduced cross sectional areas promote easier bending to reduce the magnitude of the voltage $V_e$ necessary to generate the force and torque to cause the lateral bending of the flexible longitudinal beam 111. In the second embodiment, the longitudinal force created by the movement of the actuation beam 116 is a compression force.

Figure 5:
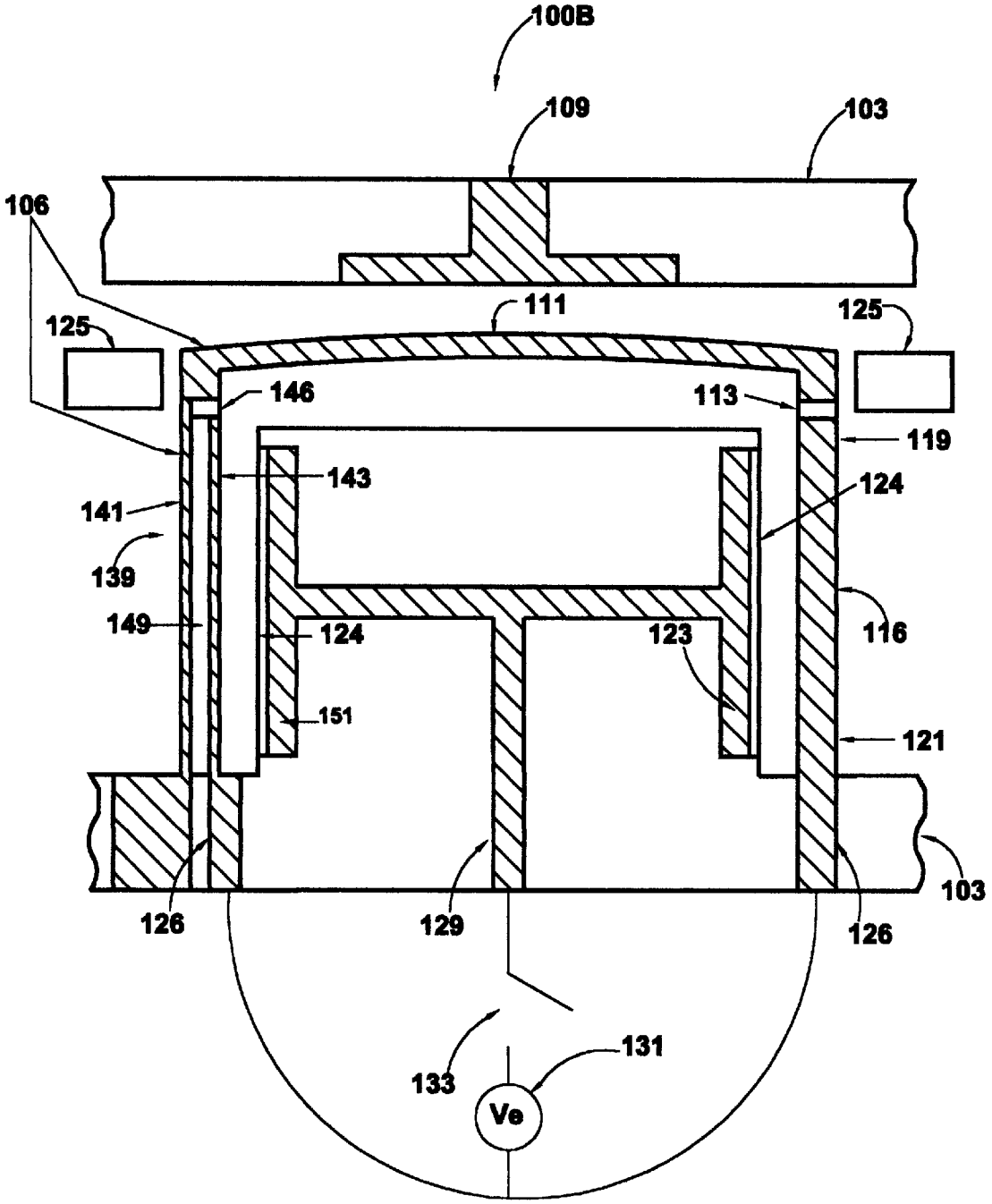
FIG. 5 is a plan cross-sectional view of a micro-electromechanical switch according to a third embodiment of the present invention using a flexible longitudinal beam as a contact member.

Turning next to FIG. 5, shown is a micro-electromechanical switch 100B according to a third embodiment of the present invention. The third embodiment uses the flexible longitudinal beam 111 as the first contact member 106. One end of the flexible longitudinal beam 111 is attached to an insulation member 113 which in turn is attached to an actuation beam 116. An actuation member 123 is disposed in the substrate 103 adjacent to the actuation beam 116. The remaining end of the flexible longitudinal beam 111 is attached to an insulated actuation beam 139 having a conducting portion 141 which is electrically coupled to the flexible longitudinal beam 111. Together, the flexible longitudinal beam 111 and the conducting portion 141 of the insulated actuation beam 139 form the first contact member 106. The insulated actuation beam 139 features a beam actuation member 143 which is electrically insulated from the conducting portion 141 by a first and second insulation members 146 and 149. An actuation member 151 is positioned adjacent to the beam actuation member 143. A voltage $V_e$ is applied across the beam actuation member 143 and its adjacent actuation member 151 as well as across the actuation member 123 and the actuation beam 116. A resulting electrostatic force arises and exerts a compression force on the flexible longitudinal member 111, which causes the flexible longitudinal beam 111 to flex in an arc-like motion approaching the second contact member 109. In this manner, a circuit applied to both the first and second contact members 106 and 109 is electrically completed.

Figure 6:
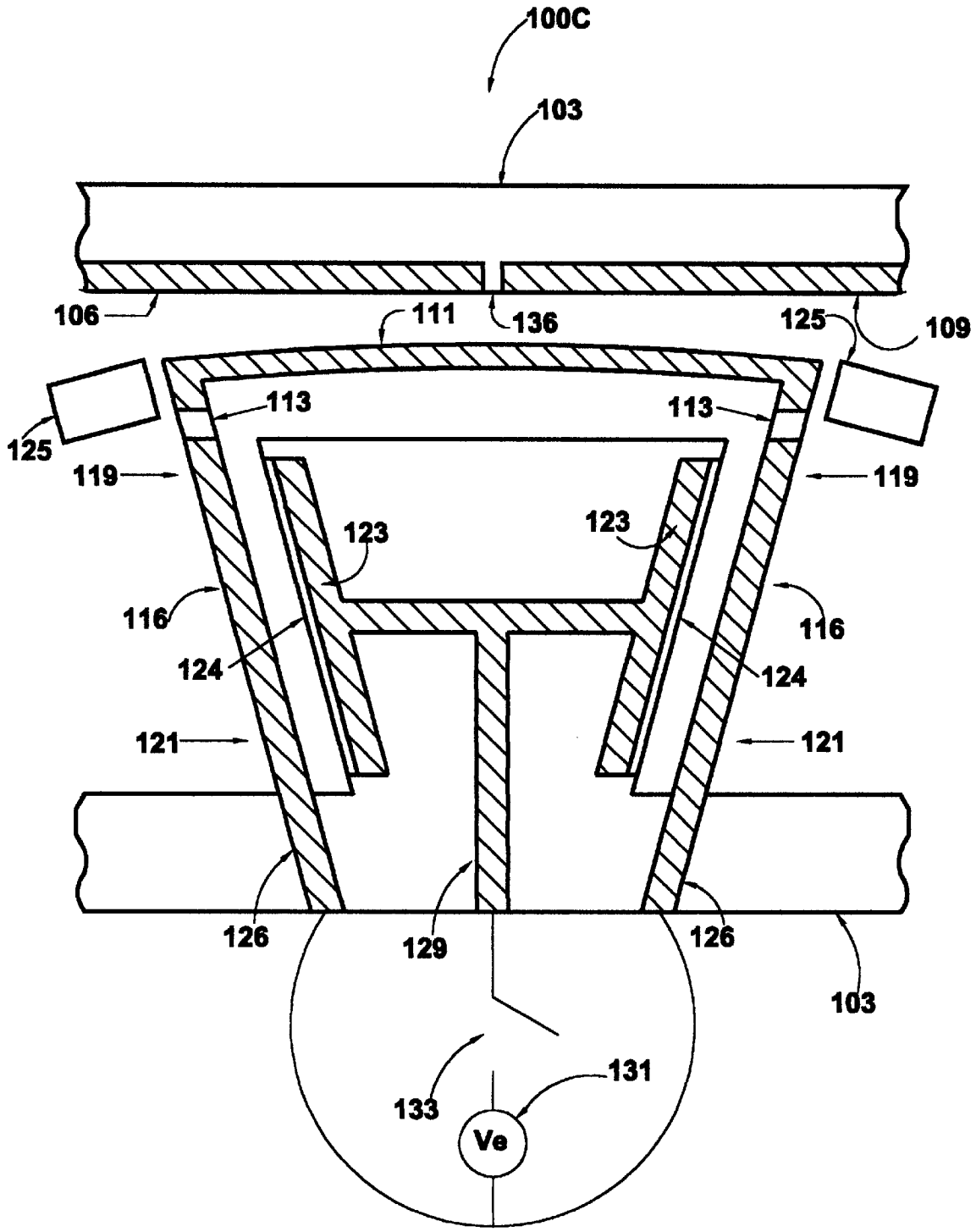
FIG. 6 is a plan cross-sectional view of a micro-electromechanical switch according to a fourth embodiment of the present invention where an angle of less than 90° is disposed between the actuating beams and the flexible longitudinal beam.

Referring then, to FIG. 6, shown is a micro-electromechanical switch 100C according to a fourth embodiment of the present invention. According to the fourth embodiment, the micro-electromechanical switch 100C is similar to the micro-electromechanical switch 100 (FIG. 3) of the first embodiment with the difference that the angle β between the actuation beams 116 and the flexible longitudinal beam 111 is less than 90°. The angle β can be optimized for specific structures and geometries for certain switch designs to reduce the force and torque needed to effect lateral bending of the flexible longitudinal beam 111.

Figure 7:
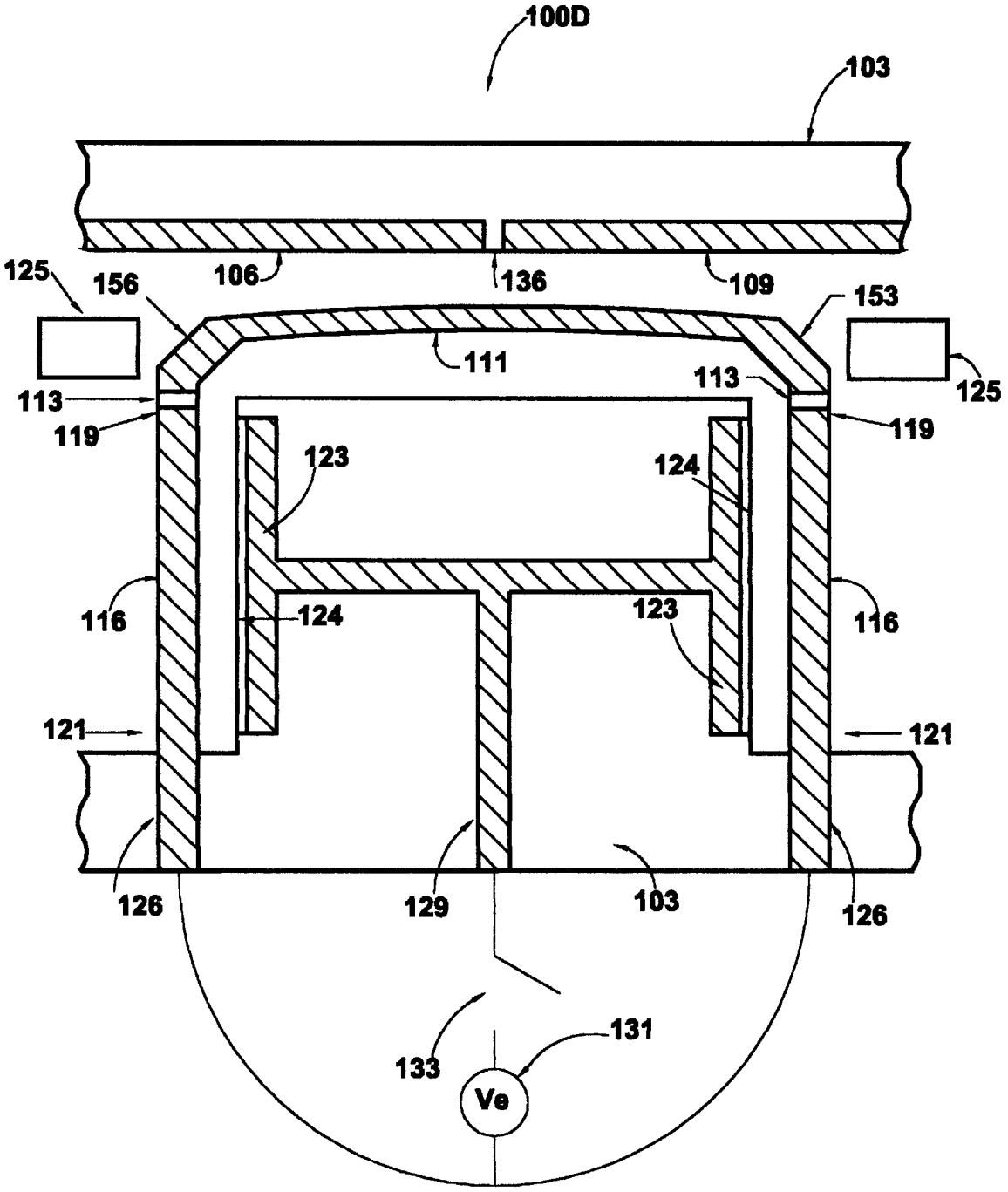
FIG. 7 is a plan cross-sectional view of a micro-electromechanical switch according to a fifth embodiment of the present invention having an angled member disposed between the actuating beams and the flexible longitudinal beam.

Turning to FIG. 7, shown is a micro-electromechanical switch 100D according to a fifth embodiment of the present invention. According to the fifth embodiment, the micro-electromechanical switch 100D is similar to the micro-electromechanical switch 100 (FIG. 3) of the first embodiment except that the ends of the flexible longitudinal beam 111 feature a first and second angled members 153 and 156. The first and second angled members 153 and 156 provide an advantage in that the force necessary to create the arc-like motion in the flexible longitudinal member 111 is reduced. Specifically, the angled members 153 and 156 transform the force more efficiently into a torque at the joint between the actuating beam 116 and the flexible longitudinal beam 111 needed for the lateral bending of the flexible longitudinal beam 111.

Figure 8:
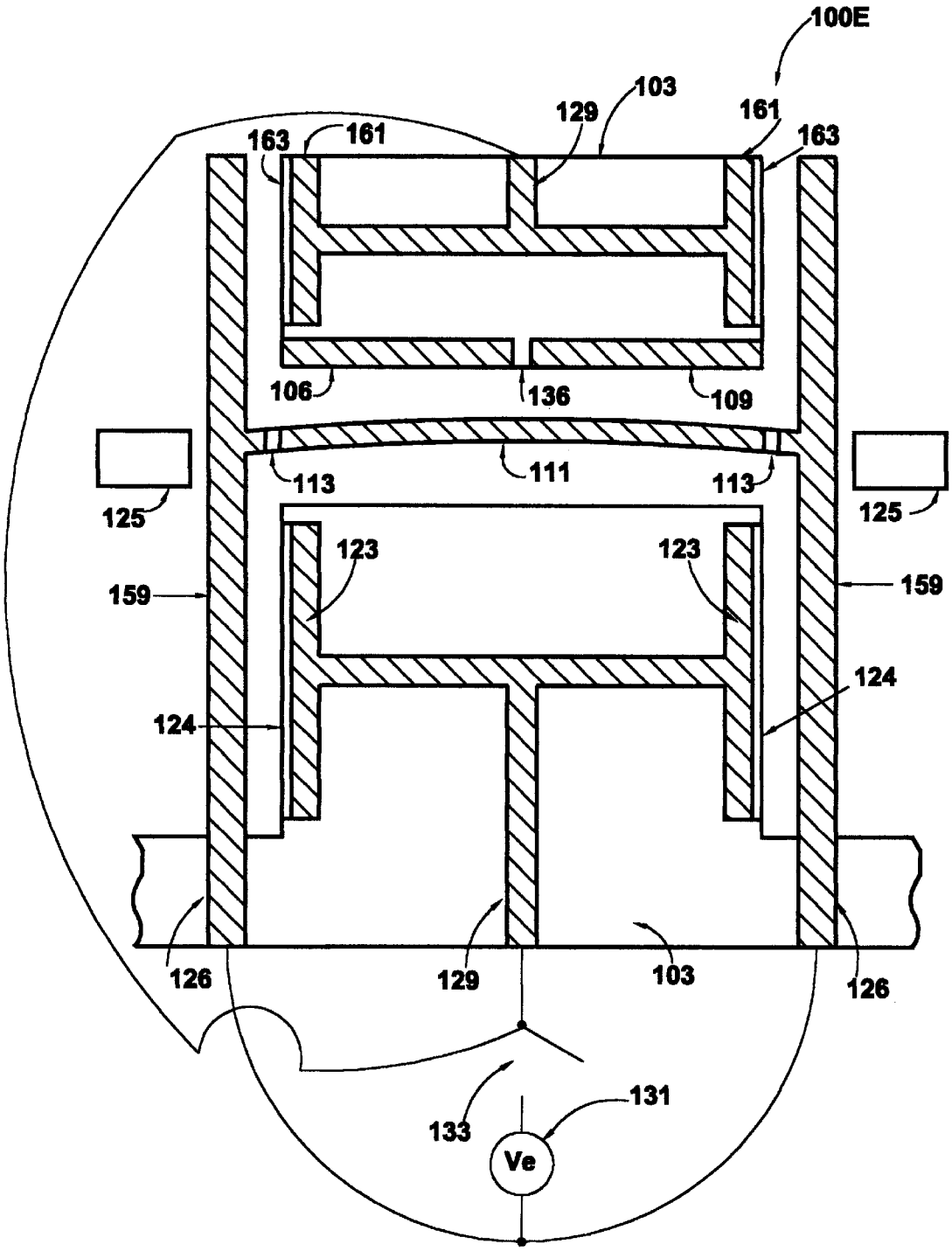
FIG. 8 is a plan cross-sectional view of a micro-electromechanical switch according to a sixth embodiment of the present invention having extended actuating beams and secondary actuation members.
Figure 9:
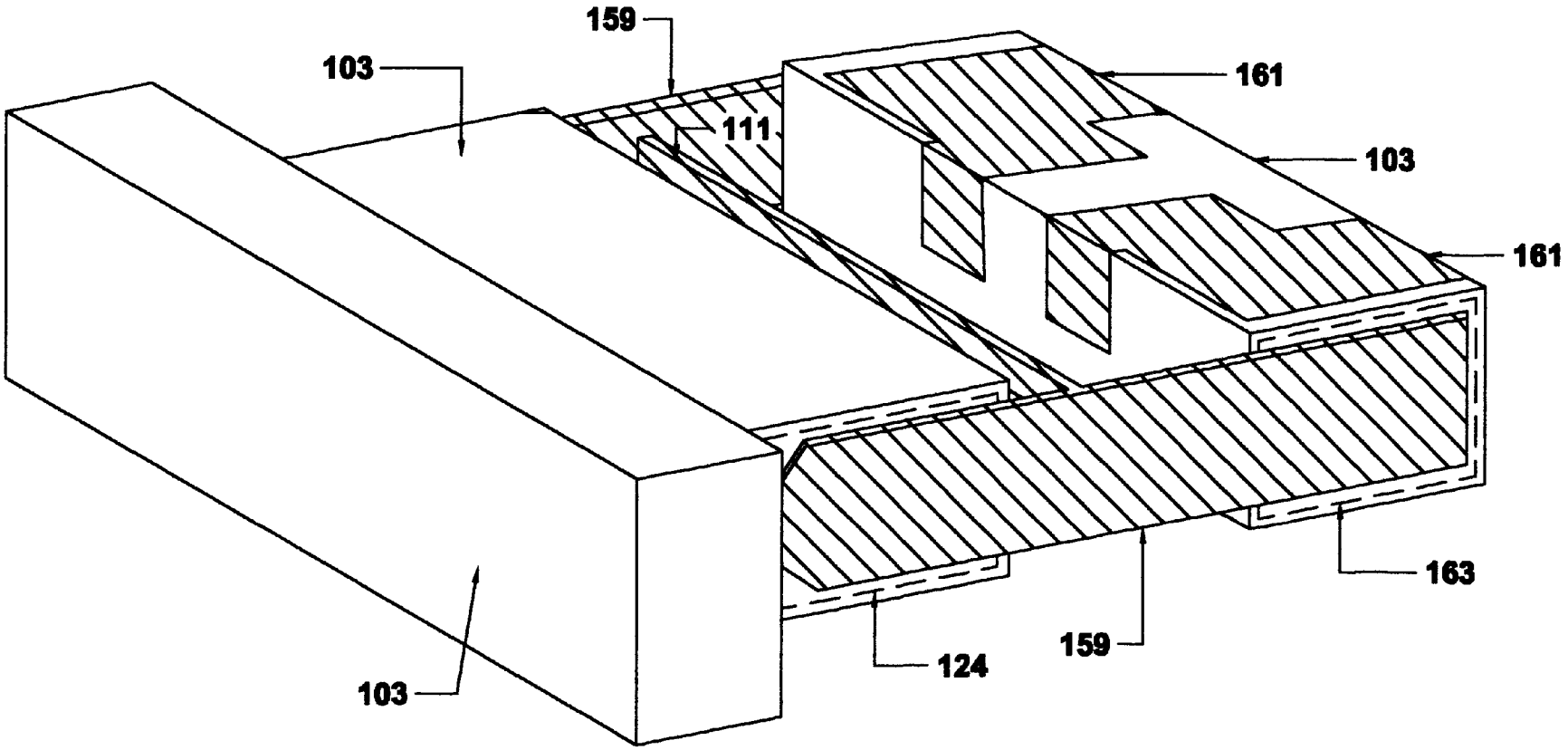
FIG. 9 is a perspective view of the micro-electromechanical switch of FIG. 8.

Turning to FIG. 8, shown is a micro-electromechanical switch 100E according to a sixth embodiment of the present invention. The micro-electromechanical switch 100E features a flexible longitudinal beam 111 with a pair of insulating members 113 on either end, the insulating members 113 being attached to a pair of extended actuating beams 159. The point along the extended actuating beams 159 at which the flexible longitudinal beam 111 is attached is generally near the middle part of the extended actuating beams 159. The micro-electromechanical switch 100E further features a pair of secondary actuation members 161 in addition to the pair of actuation members 123. When activated, a voltage $V_e$ is applied between the extended actuation beams 159 and both the actuation members 123 and secondary actuation members 161 as shown to activate the micro-electromechanical switch 100E. As a result, an electrostatic force is generated pulling the extended actuation beams 159 toward the actuation members 123 and the secondary actuation members 161. Thus, the extended actuation beams 159 generate a compression force in the flexible longitudinal beam 111 which laterally bends toward the first and second contact members 106 and 109, thereby electrically bridging the gap between the first and second contact members 106 and 109. The micro-electromechanical switch 100E is advantageous in that additional electrostatic force is generated due to the extended actuating beams 159 and the secondary actuation members 161. Consequently, the voltage $V_e$ necessary to achieve the compression force resulting in the desired lateral bending of the flexible longitudinal member 111 is reduced. FIG. 9 provides a perceptive view of the micro-electromechanical switch 100E according to the sixth embodiment. It is desirable that the extended actuating beams 159 be of a rigid design except at the point at which they are attached to the substrate 103 to ensure that any motion in the extended actuating beams 159 is transferred into the longitudinal force and torque at the joint between the extended actuating beams 159 and the flexible longitudinal beam 111. Note that a single extended actuation beam 159 and secondary actuation member 161 may be employed in the half-switch design according to the second embodiment.

Figure 10:
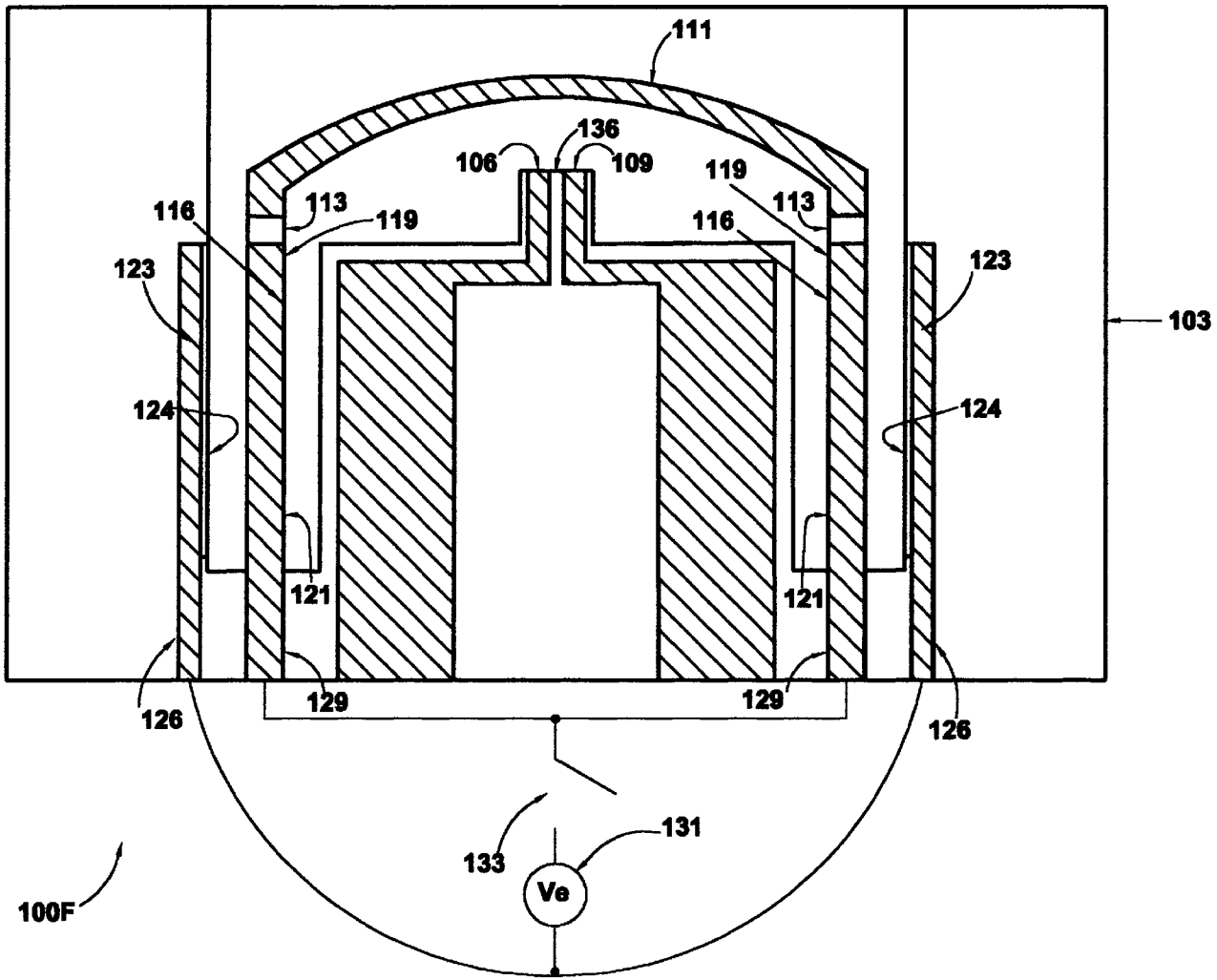
FIG. 10 is a plan cross-sectional view of a micro-electromechanical switch according to a seventh embodiment of the present invention wherein tension is employed in causing the lateral bending of the flexible longitudinal beam.

Referring to FIG. 10, shown is a micro-electromechanical switch 100F according to a seventh embodiment of the present invention. According to the seventh embodiment, the ends of a curved flexible longitudinal beam 111 are attached to insulation members 113. The curved flexible longitudinal beam 111 features a predetermined radius of curvature for reasons as will be explained. The insulation members 113 are in turn attached to actuating beams 116. The actuating beams 116 have a moveable end 119 which is attached to the insulation members 113 and a fixed end 121 attached to the substrate 103. Disposed adjacent to the actuating beams 116 are actuating members 123. A dielectric member 124 is disposed over each actuating member 123 between the actuating member 123 and the actuating beam 116 to prevent actual electric contact between the actuating member 123 and the actuating beam 116. First and second contact members 106 and 109 are disposed to be near the center of the flexible longitudinal beam 111 between the actuating beams 116. The actuating members 123 and the actuating beams 116 are electrically connected to a voltage source 131 providing voltage $V_e$ via respective electrical leads 126 and 129.

During the operation of the micro-electromechanical switch 100F, the voltage $V_e$ is applied to the actuating members 123 and the actuating beams 116, resulting in an electrostatic attraction between respective actuating members 123 and actuating beams is 116. This electrostatic force causes the actuating beams 116 to bend about their fixed end 121 toward the actuating members 123. As the actuating beams 116 bend toward the actuating members 123, they exert a tension force on the flexible longitudinal beam 111, pulling at both ends. This tension causes the flexible longitudinal beam 111 to straighten out or increase its radius of curvature. As this occurs, the center portion of the flexible longitudinal beam 111 will come near or contact the first and second contact members 106 and 109, thereby electrically bridging the gap between them. In this manner, a circuit connected to the first and second contact members 106 and 109 is electrically completed in similar fashion to the several embodiments discussed previously.

Figure 11A:
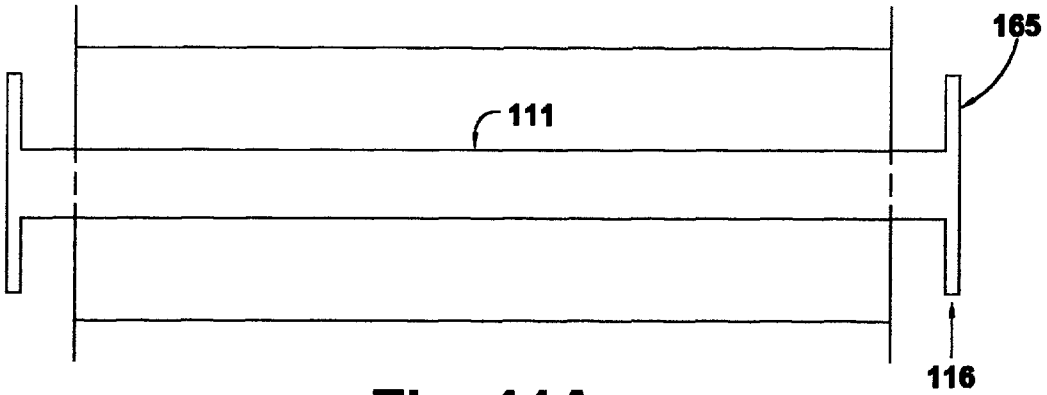
FIG. 11A is a front plan view of the actuating beams and the flexible longitudinal beam of FIG. 3.
Figure 11B:
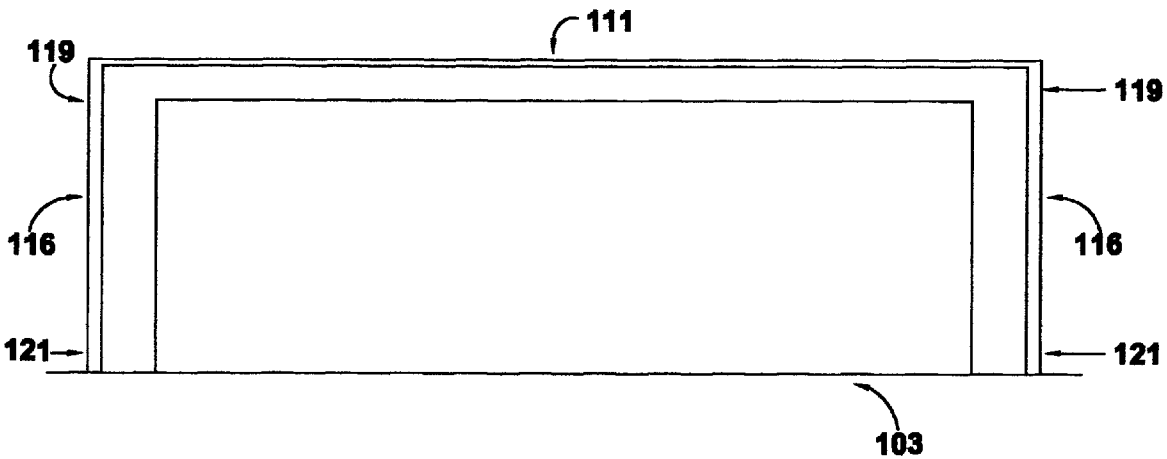
FIG. 11B is a top plan view of the actuating beams and the flexible longitudinal beam of FIG. 3.
Figure 11C:
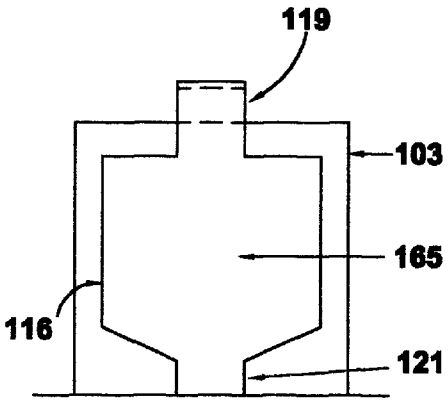
FIG. 11C is a side plan view of the actuating beams and the flexible longitudinal beam of FIG. 3.

With reference to FIG. 11, shown are three plan views of the actuating beams 116 and the flexible longitudinal beam 111 according to the first embodiment. The actuating beams 116 and the flexible longitudinal beam 111 are designed to provide the least structural resistance to the desired lateral bending motion of the flexible longitudinal beam 111 as is possible, thereby resulting in a lesser actuating force required to actuate the micro-electromechanical switch 100 according to the present invention. This is accomplished by forming the actuating beams 116 with a relatively narrow moveable end 119 and a narrow fixed end 121, and a wide center portion 165. Thus, the actuating beams 116 feature narrow cross sections at the locations where bending is experienced when activated. The wide center portion 165 is designed to provide greater surface area to maximize the electrostatic force for a given voltage $V_e$. Also, the flexible longitudinal beam 111 is designed with a smaller cross section to minimize the force necessary to cause it to laterally bend as desired.

Figure 12:
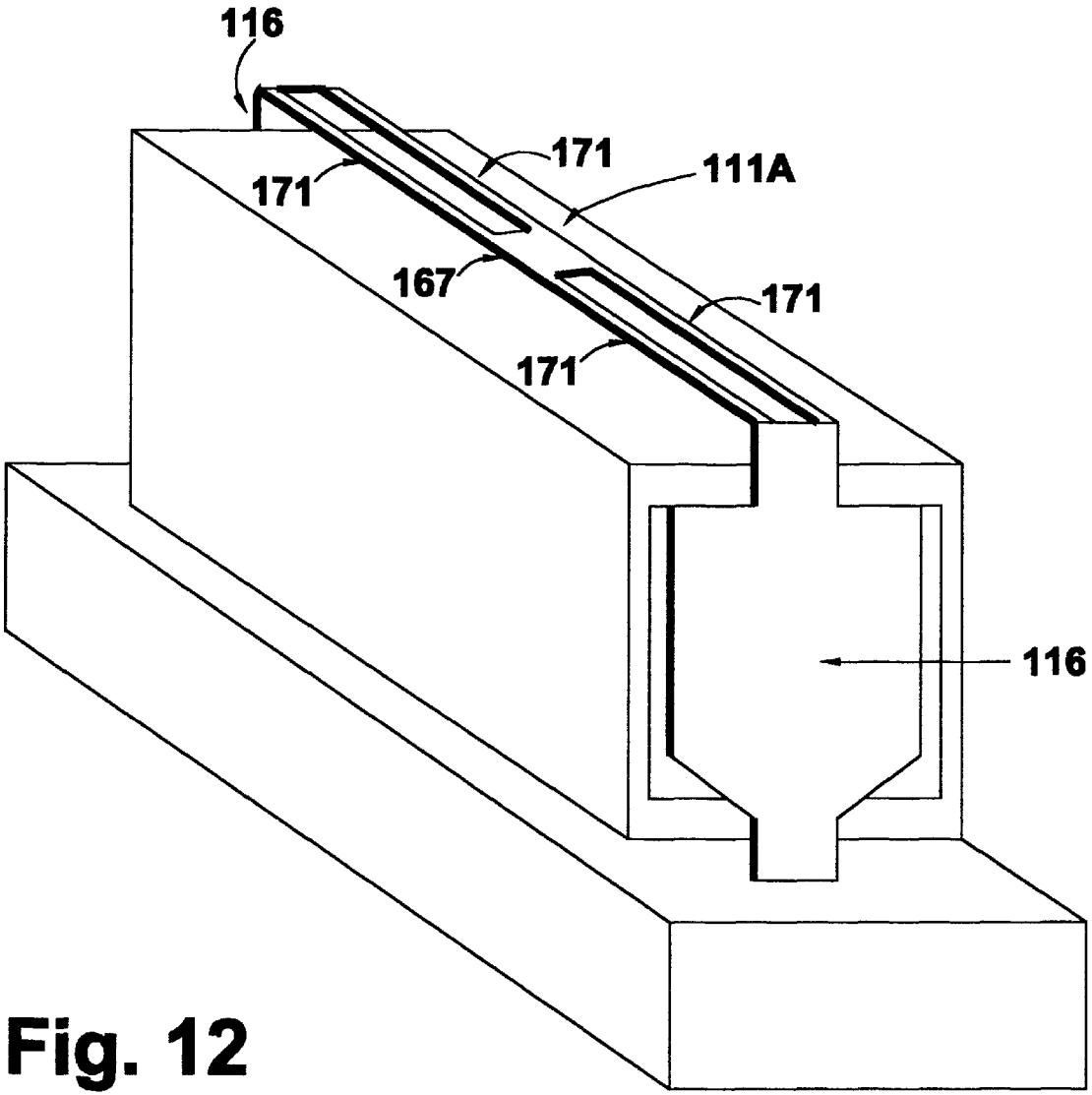
FIG. 12 is a perceptive view of the actuating beams and the flexible longitudinal beam of FIG. 3 using a sub-beam design for the flexible longitudinal beam.

Turning then, to FIG. 12, shown is a three-dimensional view of the flexible longitudinal beam 111A connected to the actuating beams 116 according to the first embodiment of the present invention. The flexible longitudinal beam 111A features a solid center pad 167 connected to several flexible sub-beams 171. This particular configuration for the flexible longitudinal beam 111A is advantageous as it provides reduced structural resistance against lateral bending, thereby reducing the necessary electrostatic force for actuation. Additionally, the multiple sub-beam design provides increased strength to resist sagging forces which may cause the flexible longitudinal beam 111A to sag in the middle. Also, the solid center pad 167 provides better resistive and capacitive contact to complete the circuit attached through the first and second contact members 106 and 109. The solid center pad 167 also provides structural strength to hold the flexible longitudinal beam together.

Figure 13A:
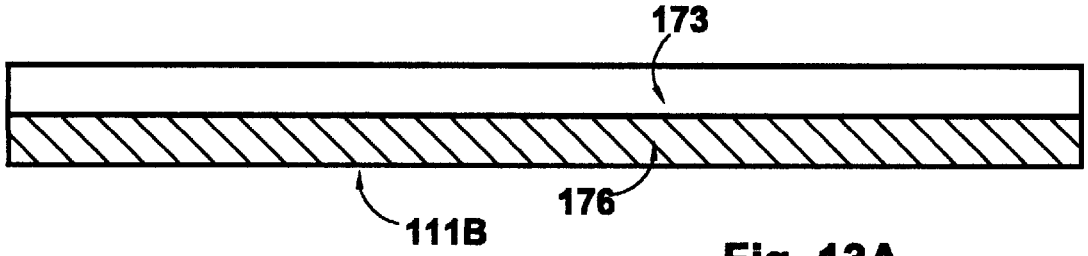
FIG. 13A is a cross-sectional view in the plane of bending movement of a flexible longitudinal beam using a two-material design.
Figure 13B:
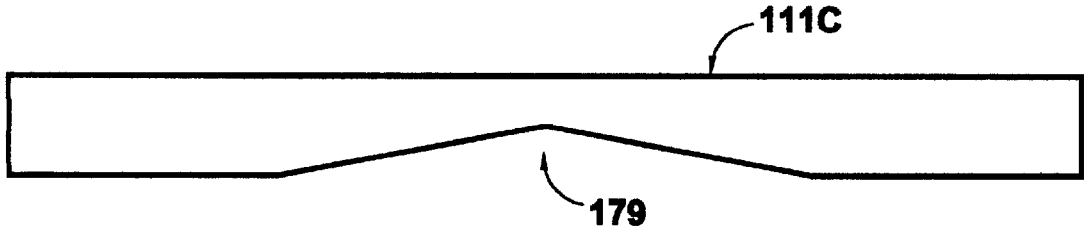
FIG. 13B is cross-sectional view in the plane of bending movement of a flexible longitudinal beam using a notched design near the center.
Figure 13C:
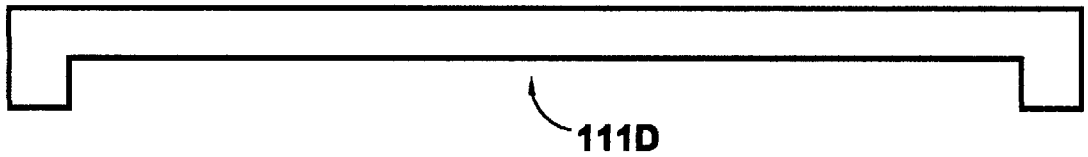
FIG. 13C is cross-sectional view in the plane of bending movement of a flexible longitudinal beam using a straight design with angled ends.

Finally, referring to FIGS. 13A though 13C, shown are cross-sectional views in the plane of bending movement of three designs for the flexible longitudinal beam 111. It is noted that the flexible longitudinal beams of FIGS. 13A though 13C are examples of anisotropic beams, that is, they are anisotropic in the direction of the bending so that they are predisposed to bend in one direction. The flexible longitudinal beam 111B features an upper layer 173 and a lower layer 176. The upper layer 173 is constructed from a material which is more ductile than the lower layer 176. Consequently, the flexible longitudinal beam 111B is predisposed to bend in an arc in one direction only. Thus the flexible longitudinal beam 111B when used with any of the forgoing embodiments is advantageous in that it is predisposed to lateral bending in the desired direction.

The flexible longitudinal beam 111C features a notch 179 in its center portion. This notch provides a weakened point on one side of the flexible longitudinal beam 111C which will facilitate easier lateral bending in a desired direction. It is possible that more than one weakened point may be disposed along the flexible longitudinal beam 111C to facilitate easier lateral bending, resulting in multiple-arc bends.

The flexible longitudinal beam 111D is another example of an anisotropic beam that is predisposed to bend in one direction.

Many variations and modifications may be made to the preferred embodiment of the invention without departing substantially from the spirit and principles of the invention. All such modifications and variations are intended to be included herein within the scope of the present invention, as defied by the following claims.

Having thus described the invention, it is claimed:

1. A micro-electromechanic switch, comprising:

a flexible longitudinal beam having a first end and a second end, said flexible longitudinal beam disposed to electrically complete an electric circuit by way of a lateral bending motion of the flexible longitudinal beam upon the application of a force to at least one of said first and second ends, thereby causing an electrical contact between the flexible longitudinal beam and at least one electrode, wherein the electrical circuit is completed by the electrical contact;

means for applying a force to at least one of said ends, said means comprising:

at least one actuating beam connected to at least said one end; and at least one actuating member adjacent to said actuating beam for moving said actuating beam upon application of an electrostatic actuating force between said actuating beam and said actuating member.

2. The micro-electromechanic switch of claim 1, wherein said flexible longitudinal beam is disposed with a predetermined initial bend in the absence of a force.

3. The micro-electromechanic switch of claim 1, wherein said first end of said longitudinal beam is insulatably connected to said actuating beam and said second end of said longitudinal beam is attached to a substrate.

4. The micro-electromechanic switch of claim 1, wherein said actuating member is an electrode and said electrostatic actuating force is generated by the application of a voltage between said actuation beam and said electrode.

5. The micro-electromechanic switch of claim 4, wherein said flexible longitudinal beam and said actuating beam form an angle of less than 90°.

6. The micro-electromechanic switch of claim 4, wherein said at least one actuating beam is connected to said at least one end of said flexible longitudinal beam with an angled member, said angled member being attached to both said flexible longitudinal beam and said actuating beam at angles of greater than 90°.

7. The micro-electromechanic switch of claim 4, wherein said flexible longitudinal beam is structurally anisotropic in the direction of said lateral bending motion, said flexible longitudinal beam being predisposed to bend in a predetermined direction.

8. The micro-electromechanic switch of claim 4, further comprising a pair of said actuating beams and a pair of said electrodes disposed adjacent thereto, each said actuating beam having a moveable end connected to one of said first and second ends of said longitudinal beam, respectively, and, each said actuating beam having a fixed end attached to a substrate.

9. The micro-electromechanic switch of claim 4, said actuating beam having a fixed end, a moveable end, and a center portion therebetween, said fixed end and said moveable end having a cross-section less than a cross-section of said center portion.

10. The micro-electromechanic switch of claim 4, further comprising a dielectric member disposed between said actuating beam and said electrode.

11. The micro-electromechanic switch of claim 8, each said actuating beam having a center portion disposed between said fixed and moveable ends, said fixed ends and said moveable ends having a cross-section less than a cross-section of said center portions.

12. A micro-electromechanic switch, comprising:

a first contact member and a second contact member having a gap therebetween;

a flexible longitudinal beam adjacent to said first and second contact members, said flexible longitudinal beam having a first end and a second end and being characterized by a lateral bending that electrically bridges said gap upon the application of a force to at least one of said first and second ends;

at least one actuating beam connected to at least one of said first and second ends; and at least one fixed actuating electrode disposed adjacent to said actuating beam sufficiently close thereto to create an electrostatic attraction between said actuating beam and said actuating electrode upon the application of a voltage therebetween.

13. The micro-electromechanic switch of claim 12, further comprising a dielectric material disposed between said actuating beam and said actuating electrode.

14. The micro-electromechanic switch of claim 12, said flexible longitudinal beam having a predetermined initial bend in the absence of said force.

15. The micro-electromechanic switch of claim 12, wherein said flex longitudinal beam is further characterized by arc-like lateral bending.

16. The micro-electromechanic switch of claim 12, wherein said flexible longitudinal beam is disposed with at least one weakened point between said first and second ends, resulting in multiple-arc bends.

17. The micro-electromechanic switch of claim 12, wherein said first and second contact members are adapted to be electrically interposed in a radio frequency (RF) transmission line.

18. A micro-electromechanic switch, comprising:

a first contact member and a second contact member having a gap therebetween, said first and second contact members being attached to a substrate;

a flexible longitudinal beam adjacent to said first and second contact members, said flexible longitudinal beam having a first end and a second end and being characterized by a lateral bending that electrically bridges said gap upon the application of a force to said first end, said second end being attached to said substrate;

an actuating beam having a moveable end and a fixed end, said moveable end being insulatably attached to said first end, and said fixed end being attached to said substrate; and an electrode attached to said substrate adjacent to said actuating beam sufficiently close thereto to create an electrostatic attraction between said actuating beam and said electrode upon the application of a voltage therebetween.

19. A micro-electromechanic switch, comprising:

a first contact member and a second contact member having a gap therebetween, said first and second contact members being attached to a substrate;

a flexible longitudinal beam adjacent to said first and second contact members, said flexible longitudinal beam having a first end and a second end and being characterized by a lateral bending that electrically bridges said gap upon the application of a force to said first and second ends;

a first actuating beam having a first moveable end and a first fixed end, said first moveable end being insulatably attached to said first end of the longitudinal beam, and said first fixed end being attached to said substrate;

a second actuating beam having a second moveable end and a second fixed end, said second moveable end being insulatably attached to said second end of the longitudinal beam, and said second fixed end being attached to said substrate;

a first electrode attached to said substrate adjacent to said first actuating beam; and a second electrode attached to said substrate adjacent to said second actuating beam, said first and second electrodes being sufficiently close to said first and second actuating beams to create an electrostatic attraction between respective said first and second actuating beams and said first and second electrodes upon the application of a voltage across said first and second actuating beams and said first and second electrodes.

20. A micro-electromechanic switch, comprising:

a first contact member and a second contact member having a gap therebetween, said first and second contact members being attached to a substrate;

a flexible longitudinal beam adjacent to said first and second contact members, said flexible longitudinal beam having a first end and a second end and being characterized by a lateral bending that electrically bridges said gap upon the application of a force to said first end, said second end being attached to said substrate;

an actuating beam attached to said first end;

a first electrode insulatably disposed on said actuating beam; and a second electrode attached to said substrate adjacent to said first electrode and sufficiently close thereto to create an electrostatic attraction between said first and second electrodes upon the application of a voltage therebetween.

* * * * *